US008591000B1

(12) United States Patent
Snyder

(10) Patent No.: US 8,591,000 B1
(45) Date of Patent: Nov. 26, 2013

(54) COMPLIANT LIQUID PATH MEMBER FOR INK RECLAMATION IN AN INK-JET PRINTER

(71) Applicant: Xerox Corporation, Norwalk, CT (US)

(72) Inventor: Trevor James Snyder, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/666,008

(22) Filed: Nov. 1, 2012

(51) Int. Cl.
*B41J 2/165* (2006.01)

(52) U.S. Cl.
USPC ..... 347/29

(58) Field of Classification Search
USPC ..... 347/29, 30, 32, 35, 90
See application file for complete search history.

(56) References Cited

U.S. PATENT DOCUMENTS

| | | | | |
|---|---|---|---|---|
| 6,231,174 | B1 * | 5/2001 | Haigo | 347/89 |
| 6,422,680 | B1 * | 7/2002 | Hayakawa et al. | 347/30 |
| 6,561,637 | B2 * | 5/2003 | Hino | 347/92 |
| 7,399,075 | B2 * | 7/2008 | Nomura et al. | 347/89 |
| 8,136,934 | B2 | 3/2012 | Snyder et al. | |
| 8,147,049 | B2 | 4/2012 | Korol et al. | |
| 2012/0123764 | A1 | 5/2012 | Ito et al. | |

* cited by examiner

*Primary Examiner* — Anh T. N. Vo
(74) *Attorney, Agent, or Firm* — Maginot, Moore & Beck, LLP

(57) ABSTRACT

In an inkjet printing machine, an ink reclamation device receives ink emitted from at least one printhead in a purge cycle. The ink reclamation device includes a liquid path member in the form of a thin compliant or flexible sheet configured to contact the face of the printhead proximate to the inkjets to receive purged ink within a trough formed by the sheet. The liquid path member includes a plurality of slots defined in the sheet, the slots having a width sized to promote meniscus formation of liquid ink within the trough. The meniscus hardens to plug the slots so that the trough fills during the inkjet purge. The ink reclamation apparatus may be heated to melt the ink within the trough to return the ink to an ink reservoir in the printhead.

20 Claims, 4 Drawing Sheets

COMPLIANT LIQUID PATH MEMBER FOR INK RECLAMATION IN AN INK-JET PRINTER

TECHNICAL FIELD

This disclosure relates generally to systems that supply and recover fluid from a device, and more particularly, to an inkjet printer configured to supply liquid ink to an ink reservoir within an inkjet printing apparatus and recover liquid ink from a receptacle associated with the inkjet printing apparatus.

BACKGROUND

Fluid transport systems are well known and used in a number of applications. One specific application of transporting a fluid in a machine is the transportation of ink in a printer. Common examples of inks include aqueous inks and phase change or solid inks. Aqueous inks remain in a liquid form when stored prior to being used in imaging operations. Solid ink or phase change inks typically have a solid form at room temperature, either as pellets or as ink sticks of colored ink, which are inserted into feed channels in a printer through openings to the channels. After the ink sticks are fed into the printer, they are urged by gravity or a mechanical actuator to a heater assembly of the printer. The heater assembly includes a heater and a melt plate. The heater, which converts electrical energy into heat, is attached to the melt plate to heat the melt plate to a temperature that melts an ink stick coming into contact with the melt plate. The melt plate can be oriented to drip melted ink into a reservoir and the ink stored in the reservoir continues to be heated while awaiting subsequent use.

The reservoir can be attached directly to the printhead or can be a separate subsystem. With either approach, fluid couplings in the printer supply the liquid ink held in each reservoir of colored ink to one or more printheads in the inkjet printing apparatus. The liquid ink is pumped from the reservoir to a manifold in the inkjet printing apparatus. The manifolds are connected through channels to numerous individual inkjet ejectors. As the inkjets in the printheads eject ink onto a receiving medium or imaging member, the action of the diaphragms in the inkjets pulls ink from the manifold. Various embodiments of inkjets include piezoelectric and thermal devices that are selectively activated by a controller with an electrical firing signal.

Phase change ink printers often include one or more heaters that maintain a supply of phase change ink in a liquid state for use during printing operations. Typically, the heaters are electrical heaters that consume electrical energy to maintain the phase change ink in a liquid phase. In order to reduce energy usage, phase change ink printers deactivate various components, including heaters, in the printer during a sleep mode to conserve energy. The ink held in the printheads and inkjets cools and solidifies in some sleep modes.

While sleep modes enable a printer to operate with reduced electrical energy consumption, the solidification of phase change ink within the printer presents difficulties to printing high quality documents when the printer emerges from sleep mode. As phase change ink within an inkjet printing apparatus cools and solidifies, the ink contracts and air enters the pressure chambers and fluid conduits within the printheads. As the solidified ink heats and liquefies during a subsequent warm-up process, the air forms bubbles in the liquefied ink that can prevent inkjets in the printheads from operating reliably. Additionally, during the warm-up process, both the ink and air bubbles expand due to the heat applied to the printheads. The expanding air bubbles may force some ink through the ejector nozzles, which is referred to as "drooling." The drooled ink can contaminate other nozzles in the printheads or separate from the printheads and produce errant marks on the image receiving member.

To eliminate air bubbles in the liquefied ink within the printheads and to clear contaminants from the inkjet nozzles and external face of each printhead, the inkjet printing apparatus undergoes a "purge" operation where pressure applied to the printheads urges the liquid ink and the air bubbles through the nozzles of the inkjets. In a purge operation, the inkjets emit a stream of ink that flows down the face of the printhead and is collected in a waste ink receptacle instead of being ejected as individual ink drops. The purge operation removes air bubbles from the inkjets in the printheads and other fluid conduits in the inkjet printing apparatus.

In some printing apparatus designs, a wiping operation occurs after the purge operation. In a wiping operation, a wiper blade engages the face of a printhead and moves across the printhead face, including the inkjet nozzles. The wiper blade cleans residual ink and contaminants on the face of the printhead from the purge operation. The wiping operation maintains the meniscus formed between the liquid ink and nozzle in each of the inkjets in the printhead. The meniscus may be broken if the liquid ink contacts a contaminant or another mass of liquefied ink on the face of the printhead. The wiping operation clears the contaminants to enable each inkjet to maintain the meniscus for reliable operation.

In existing printers, the purged ink and ink from a wiping operation is typically collected in a waste reservoir and is eventually discarded. In printers that enter sleep modes more often to reduce electrical energy consumption, the number of purge cycles and the corresponding amount of discarded ink increases. A desirable improvement to phase change ink-jet printers would reduce or eliminate discarded ink produced during purge cycles.

SUMMARY

In one embodiment, a printing apparatus that reclaims purged ink is provided with an ink reclamation device having a housing forming a receptacle configured to hold a volume of ink, the receptacle having an outlet for flowing liquid ink into an ink supply when the container is in a reclamation position. The reclamation device is further provided with a liquid path member having a first end positioned within the receptacle and a second end extending from the receptacle and the housing, and a positioning system operatively connected to the housing and configured to move the housing between the reclamation position and a purge position. In the purge position the housing is arranged to engage the second end of the liquid path member with a face of a printhead at a location below a plurality of inkjets formed in the printhead to provide a fluid path to the receptacle for ink emitted from the plurality of inkjets.

In one aspect, the liquid path member defines a U- or V-shaped trough and the second end of the member defines an edge adapted for fluid tight contact with the printhead in the purge position of the reclamation container. The base of the U-shaped trough is provided with a plurality of narrow slots in communication with the receptacle beneath the liquid path member. The slots are dimensioned so that liquid ink forms a meniscus over the slots when the reclamation container, thereby preventing the flow of liquid ink from the trough into the receptacle. The ink in the meniscus hardens to close the trough and retain the purged ink within the reclamation container until the container is moved to its reclamation position.

Thus, in one aspect, slots are added to the liquid path member which are small enough to hold some ink against gravity to thereby allow the ink to cool and solidify. The ink that bridges the gaps creates a plug which acts as a temporary seal to hold future liquid ink within the liquid path member. The slots are small enough to allow capillary forces to trap a thin layer of ink during solidification, but are large enough to allow flow of the bulk of the liquid ink during the recirculation process.

DETAILED DESCRIPTION

Figure 1:
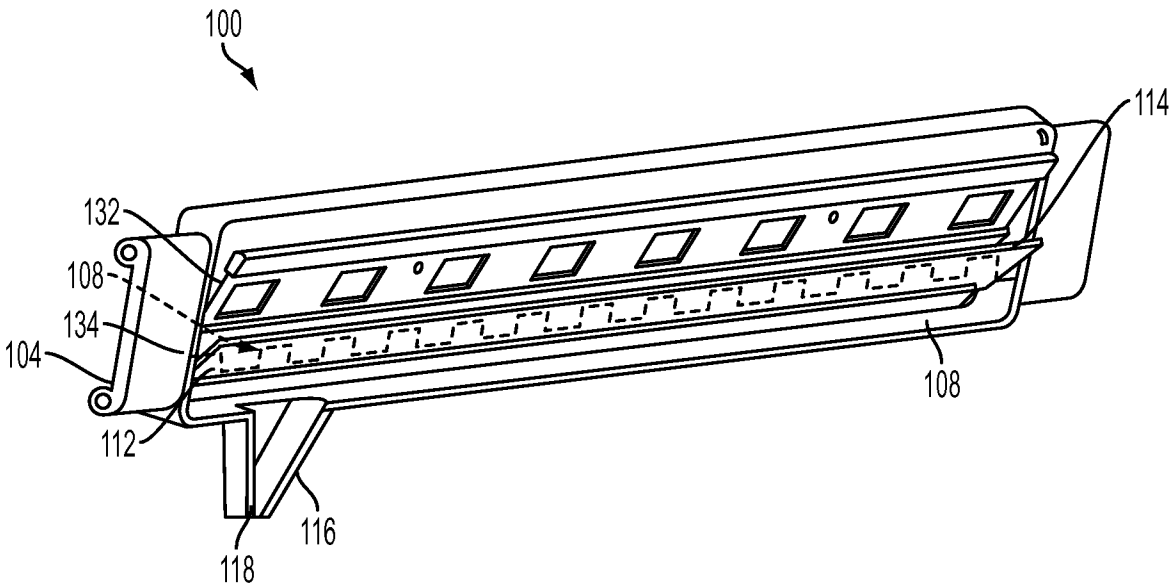
FIG. 1 is a perspective view of an ink reclamation device according to one aspect of the present disclosure.

For a general understanding of the environment for the system and method disclosed herein as well as the details for the system and method, reference is made to the drawings. In the drawings, like reference numerals have been used throughout to designate like elements. As used herein, the term "purge" refers to a maintenance procedure performed by an inkjet printing apparatus to forcibly expel ink from the inkjet ejectors in one or more printheads in an effort to clear the inkjet ejectors and not to form an image on an image receiving surface. A purge can be performed by applying air pressure to an ink reservoir that is fluidly coupled to the inkjets in the printheads or by applying suction to the inkjet nozzles. A purge is typically used to remove air bubbles from conduits within the printheads or other sections of a fluid path in the inkjet printing apparatus that form each time phase change ink is melted from solid to liquid. A purge can also be used to clear contaminants from inkjet ejectors. The term "purged ink" refers to ink expelled during a purge operation. The purged ink flows down the face of the printhead instead of being ejected toward an image receiving surface. As used herein, the terms "solid ink" and "phase change ink" both refer to inks that are substantially solid at room temperature and substantially liquid when heated to a phase change ink melting temperature for jetting onto an imaging receiving surface. The phase change ink melting temperature can be any temperature that is capable of melting solid phase change ink into liquid or molten form.

As used herein, the term "face" in the context of a printhead refers to an approximately planar region of a printhead that includes a plurality of inkjet nozzles. The printhead ejects ink drops through the apertures in a face plate, sometimes called "nozzles," of the printhead onto an image receiving surface during a printing operation. During a purge operation, ink flows through the nozzles and onto the face of the printhead. It is contemplated that the devices described herein may be adapted for use with single color or multi-color printheads. The devices described herein may be adapted for use in 4-to-1 reclamation of multi-color printheads, in which four ink colors are combined in the reclamation container and recirculated to a black ink supply, or may be adapted to separately recirculate each color to its own ink supply.

In order to reduce or eliminate discarded ink produced during purge cycles in a phase change ink-jet printer, the printer may be provided with an ink reclamation device as depicted in FIGS. 1-3C. FIG. 1 depicts an ink reclamation device 100 including a single ink receptacle that receives purged ink from a printhead, holds the purged ink within the receptacle, and empties the purged ink into an ink supply. The ink reclamation device 100 collects ink purged in inkjet printers, holds the purged ink and returns the purged ink to an ink supply in the printer. The reclamation device 100 includes a housing 104 that forms a receptacle 108 and an outlet 116. A liquid path member 112 extends outward from an opening of the receptacle 108. A wiper 132 is positioned above the receptacle 108 and extends outward from the housing 104. In the embodiment of FIG. 1, the housing 104, receptacle 108, liquid path member 112, and wiper 132 each have a width that corresponds to the width of the face of one printhead. In an alternative embodiment, the housing 104, the receptacle 108, the liquid path member 112, and the wiper 132 each have a width corresponding to two or more printheads that are arranged in a printhead array.

In FIG. 1, the liquid path member 112 extends upward from the housing 104 at an acute angle from a vertical face of the housing 104. An end 114 of the liquid path member 112 contacts the face of the printhead during a purge operation. The liquid path member 112 is formed from a compliant material such as a sheet of plastic or a flexible metal sheet. In one embodiment, the liquid path member is formed from a sheet of a thermally conductive polymer with a thickness of approximately 0.075 mm. The thermally conductive material forming the liquid path member 112 receives heat from the printhead when the end 114 of the liquid path member 112 engages the face of the printhead. The liquid path member 112 also has a low thermal mass in comparison to the housing 104. Consequently, the temperature of the liquid path member 112 increases quickly when the end 114 engages a printhead and liquid ink flows over the liquid path member 112. The low thermal mass of the liquid path member 112 also limits a transfer of heat from the printhead to the housing 104, which enables the receptacle 108 to maintain a temperature that is below the freezing point of the phase change ink. The orientation of the liquid path member 112 enables the liquid path member 112 to provide a fluid path for ink emitted from the printhead to flow into the receptacle 108 using both capillary forces and gravity to draw the ink into the receptacle 108.

The liquid path member 112 is configured to provide a path for liquid ink to flow from the printhead to the receptacle and to maintain a temperature that enables the purged ink to remain liquid until the ink has flowed into the receptacle 108.

The resilient material in the liquid path member 112 flexes when engaged to the face of the printhead to conform to the surface of the printhead and form a liquid seal across the face of the printhead that directs the purged ink toward the receptacle 108. The liquid path member 112 thus draws purged ink from the face of the printhead toward the receptacle 108 via capillary action as well as through force of gravity.

In the housing 104, the outlet 116 is fluidly coupled to the receptacle 108. Phase change ink flows into the receptacle toward the outlet 116 under the force of gravity. The outlet 116 is formed in a funnel shape that directs the ink to an outlet opening 118. During a purge operation, the housing 104 and outlet 116 are thermally isolated from the printhead and other heated components in an inkjet printer, including heaters in the printhead that heat phase change ink to liquefy the phase change ink for printing and purging operations. Upon entering the receptacle 108, the liquid phase change ink cools and solidifies in the receptacle. Any liquid ink that flows into the liquid path member 112 cools and solidifies within the receptacle 108. For small purge masses (such as 1-3 g per purge) the housing and liquid path member have sufficient thermal mass to absorb heat from the ink to allow the ink to cool and solidify. Even after emptying the systems completely, capillary forces will cause some ink to remain behind.

The ink reclamation device 100 may include an optional heating element 134 positioned within the housing 104 and extending along the width of the ink receptacle 108. The heating element 134 may be an electrical resistive heater formed from nichrome wire or another resistive heating element. The heating element 134 may be activated when the ink reclamation device 100 and outlet 116 are moved into fluid communication with an ink supply. The heating element 134 melts the solidified phase change ink in the receptacle 108 and in the outlet 116. The liquid ink flows out of the receptacle 108 through the outlet 116 and opening 118, and subsequently enters an ink supply.

The ink reclamation device 100 includes an optional wiper 132 that engages the face of the printhead to remove excess purged ink that remains on the face of the printhead after a purge operation. The orientation of the wiper 132 enables the wiper 132 and the liquid path member 112 to engage the face of the printhead as the wiper 132 moves across the face of the printhead during a printhead maintenance operation. In one embodiment, the wiper 132 is positioned on the surface of the printhead at a location above the excess ink, and an actuator moves the housing 104 and wiper 132 downward across the face of the printhead. The wiper 132 removes the excess ink from the face of the printhead where the excess ink could interfere with operation of inkjets in the printhead. Given the position of the liquid path member 112 directly below the wiper 132, the excess ink from the wiper can be reclaimed and stored in the liquid path member during the wipe process.

The ink reclamation device 100 of FIG. 1 is configured for use with both single color and multicolor printheads. A single color printhead ejects one color of ink, such as one of a cyan, magenta, yellow, or black ink in a CMYK color printer. In one configuration, the ink reclamation device 100 collects ink from only one printhead and returns the collected ink to an ink supply that supplies the printhead. In another configuration, the ink reclamation device 100 collects ink from each printhead in a plurality of single color printheads. The inks from each printhead mix in the receptacle 108 and the mixed inks are recirculated into a black ink supply for ejection by a black ink printhead, often referred to as a mono or 4-in-1 recirculation. In a multicolor printhead configuration, groups of inkjets formed in the printhead are fluidly coupled to ink supplies that each hold a different color of ink. During a purge operation, the multicolor printhead purges ink of two or more colors into the receptacle 108. The ink reclamation device holds the combined ink in the receptacle until the ink is recirculated into a black ink supply. It is contemplated that the housing 104 may be modified to support separate liquid path members and receptacles for each color to return or recirculate each color to its respective ink supply.

Figure 2:
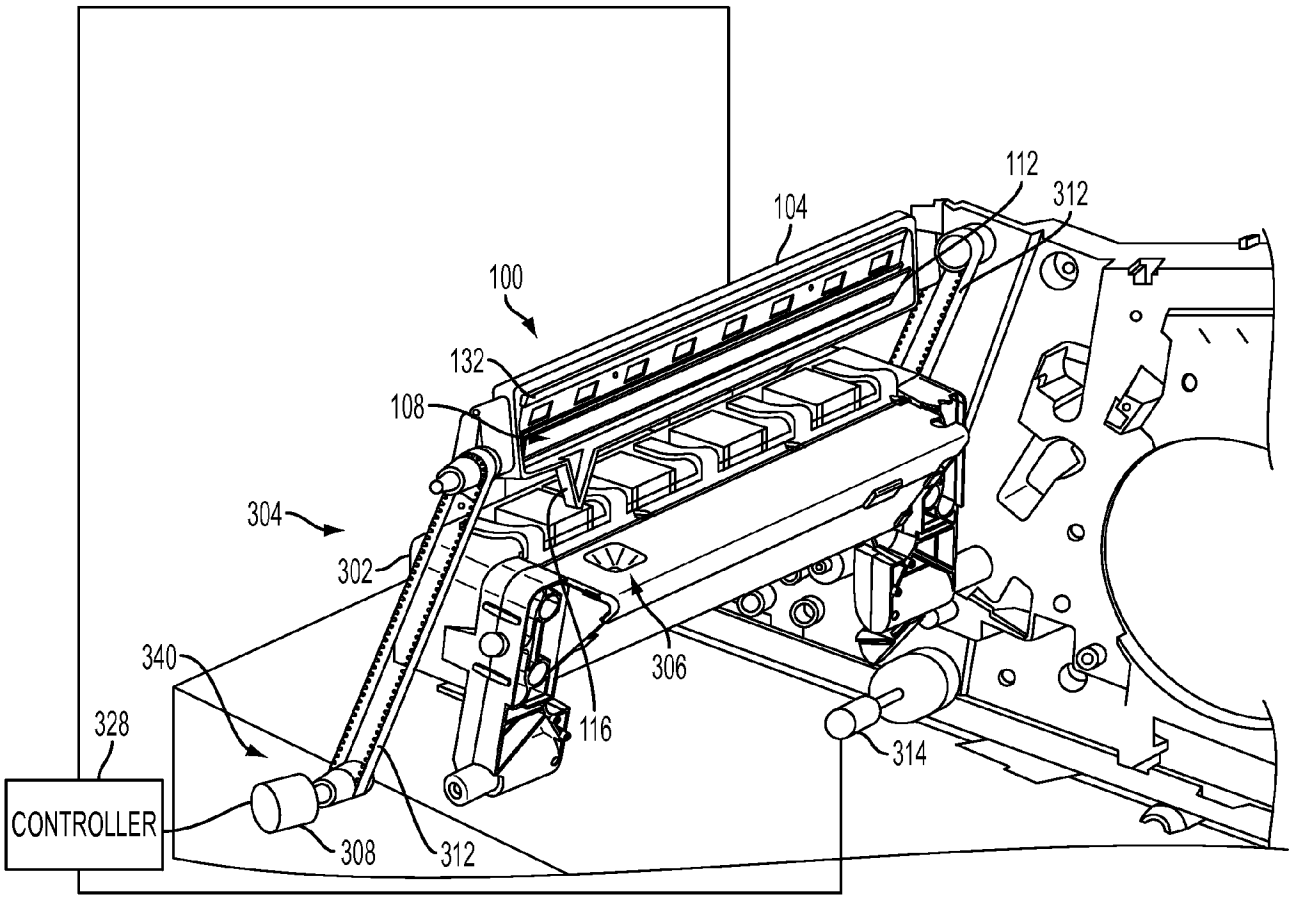
FIG. 2 is a perspective view of the reclamation container of FIG. 1 located above an ink supply of a printhead in an inkjet printer, including a positioning system for positioning the reclamation container and printhead with respect to each other in ink purge and reclamation positions.

In operation within an inkjet printer, a positioning system moves the ink reclamation device 100 between at least two locations to collect purged ink within the containers and to return the purged ink to an ink supply. FIG. 2 depicts a positioning system 340 in an inkjet printer that moves the ink reclamation device 100 into engagement with the face 302 of printhead 304 and into fluid communication with an ink supply 306. The positioning system 340 includes an actuator 308 that drives two toothed belts 312 that engage each end of the ink reclamation receptacle 100 along the width of the housing 104. The positioning system 340 also includes a printhead actuator 314 that moves the printhead to engage and disengage the liquid path member as described herein. A controller 328 is operatively connected to the ink receptacle actuator 308 and printhead actuator 314 in the positioning system 340 and to the optional heating element 134 in the in reclamation receptacle 100. The controller 328 may be a digital controller such as a microcontroller, microprocessor, field programmable gate array (FPGA), application specific integrated circuit (ASIC) or the like. During a purge operation, the controller 328 selectively activates the actuators to collect and recirculate purged ink.

Figure 3A:
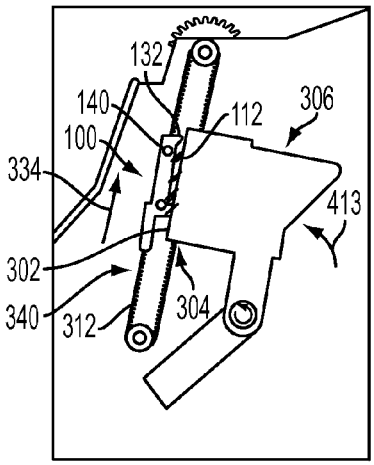
FIG. 3A is a profile view of an ink reclamation device engaged to the face of a printhead in a first ink purge position.

Thus, as depicted in FIG. 3A the ink receptacle 100 is engaged to the face 302 of the printhead 304. The positioning system 340 may be configured to move the ink reclamation device 100 in direction 334 up the face 302 of the printhead 304. This movement would typically occur with the liquid path member 112 held offset from the printhead face 302 but could occur with the member in contact with the face. In the example of FIG. 3A, the printhead actuator moves the printhead in the direction 413 into engagement with the liquid path member 112 in the ink reclamation device 100. Purged ink from inkjets then flows from the printhead face 302 down the liquid path member 112 into the ink reclamation device 100.

Figure 3B:
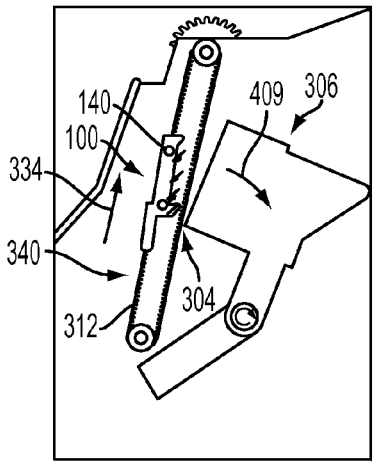
FIG. 3B is a profile view of the ink reclamation device and printhead of FIG. 3A, with the printhead being rotated to disengage from the container.
Figure 3C:
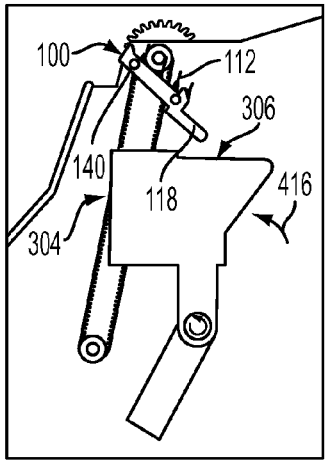
FIG. 3C is a profile view of the ink reclamation device and printhead of FIG. 3B, with the ink reclamation device and printhead being moved to a reclamation position in which the container is positioned above an ink supply of the printhead.

Once the purged ink has been collected, the printhead actuator moves the printhead in the direction 409 to disengage the printhead 304 from the ink reclamation device 100, as shown in FIG. 3B. The ink reclamation device then moves in direction 334, typically without dragging or otherwise contacting the printhead face 302. FIG. 3C depicts the ink reclamation device 100 in a position to return purged ink stored in the ink receptacle 108 to the ink supplies 306. The printhead actuator moves the printhead 304 in direction 416 to position the opening to the ink supply 306 beneath the ink reclamation device 100. The ink reclamation device is rotated about a pivot to position the outlet 118 in fluid communication with opening in the ink supply, as shown in FIG. 3C. The heating element 134 may be activated to melt ink held in the receptacles 108 to recirculate the ink to the printhead 304 for future printing operations.

As reflected in FIGS. 3A-3C, the liquid path member 112 is at one attitude or orientation when collecting purged ink (FIG. 3A) and at another attitude when returning the ink to the ink reservoir 306 (FIG. 3C). The collected ink hardens within the liquid path member 112, thereby retaining the collected ink as the reclamation container 100 is moved to the reclamation position of FIG. 3C. A certain amount of residual ink is also present in the housing 104, the receptacle 108 and the outlet 116. All of this ink solidifies and must be melted to recirculate or flow the ink back into the ink reservoir 306. The heating element 134 must melt all of the ink from within the liquid path member 112 as well as within the receptacle 108, housing 104 and outlet 116.

Referring to FIGS. 4A-4D, a liquid path member 200 is illustrated that is includes a U-shaped or V-shaped body 202 that defines a receptacle or trough 208 for receiving purged ink. In the illustrated embodiment the body 202 is mounted to the wiper 132 of the ink reclamation device 100. It is thus contemplated that the liquid path member 200 is used in lieu of the member 112 shown in FIGS. 1-2. The U-shaped body 202 includes an inner wall 210 that is fastened or affixed to the wiper 132. Alternatively, the inner wall 210 may be mounted to the housing 104. The body further includes an outer wall 212 defining an end or edge 214. Like the liquid path member 112, the member 200 is formed of a resilient material so that the 200 flexes when the outer wall 212 is engaged to the face of the printhead (304) to conform at least the edge 214 to the surface of the printhead and form a liquid seal across the face of the printhead that directs the purged ink toward the trough 208. The compliant material may be a sheet of plastic or a flexible metal sheet. In one embodiment, the material is a thin stainless steel sheet with a thickness of approximately 0.075 mm, although other materials are contemplated that have a comparable compliance and thermal conductivity. The thermal conductivity of the material for the element 200 transfers heat to all of the solidified ink contained within the trough after an ink jet purge, as described above.

Figure 4B:
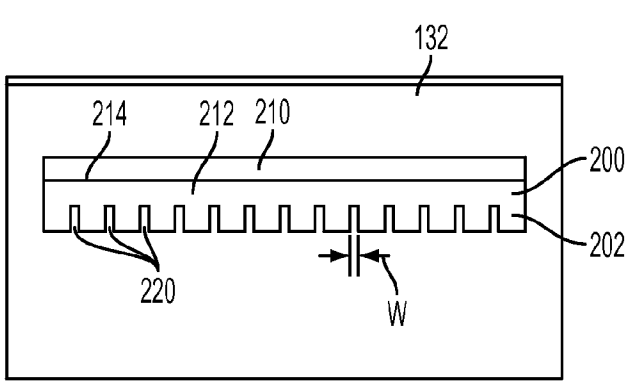
FIG. 4B is a front view of the wiper and liquid path member shown in FIG. 4A.
Figure 4A:
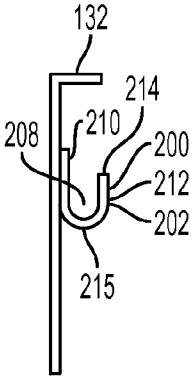
FIG. 4A is a side view of a wiper with a liquid path member mounted thereon according to one embodiment disclosed herein.

In one aspect of the liquid path member, the body 202 is provided with a plurality of slots 220 defined at the base 215 of the U-shaped body, as best seen in FIG. 4B. Each slot has a width W that is sufficiently narrow that liquid ink within the trough 208 can form a meniscus across the slot. It is known that the ability of a liquid to form a meniscus is a function of the surface tension of the liquid, as well as the dimension of the space being spanned by the meniscus. If the slot is too wide the surface tension is not able to form the meniscus. On the other hand, if the slot is too narrow the molten ink may not pass freely through the slot in the absence of some additional hydraulic pressure to push the ink through the slot. For a liquid ink of the type typically used in printing machines, a suitable width W of the slots 220 is about 0.25-1.0 mm. A suitable width of the slots 220 for a particular molten ink can be readily derived empirically.

The length of the slots at the base 215 of the U-shaped body can vary but it is desirable that the slots have a sufficient area for the molten ink to readily flow out of the trough 208 and into the ink supply 306 during the reclamation step (FIG. 3C). In one embodiment the slots have a length that is greater than the width. In a specific embodiment the slots have a width of about 0.25 mm and a length of about 20 mm along the base 215 of the U-shaped body 202. It can also be appreciated that the number of slots 220 may vary, as well as the spacing of the slots along the length of the liquid path member 200. Again, the design factor for the number and spacing of the slots is to provide sufficient flow area for the purged ink within trough 208 to flow quickly into the ink supply, to thereby minimize the time required for a complete purge cycle. In the embodiment described above, twenty slots 220 are provided at a spacing of about 10 mm.

Figure 4D:
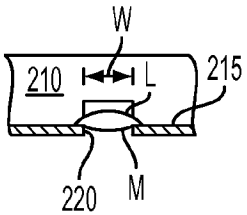
FIG. 4D is an enlarged partial cross sectional view of a slot in the liquid path member shown in FIG. 4C with a liquid ink drop forming a meniscus in the slot.
Figure 4C:
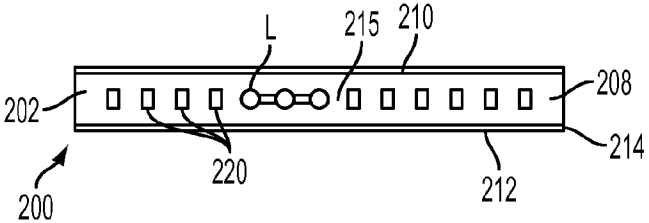
FIG. 4C is a top view of the liquid path member shown in FIGS. 4A and 4B.

Thus, as shown in FIG. 4C, during a purge operation liquid ink L will drip to the base 215 of the body 202 and migrate toward the slots 220. The liquid L is depicted as covering only three slots, although it is appreciated that the remaining slots will be covered as more ink is purged. As shown in FIG. 4D, the liquid ink L at a slot forms a meniscus M in the slot due to the surface tension in the liquid ink, which thus prevents the ink from passing through the slot. As more purged ink drips into the liquid path member every slot will be covered by the liquid ink so that every slot is blocked. Since the liquid path member is unheated at this stage, the ink in the meniscus solidifies, thereby plugging the slots so that any new ink received within the liquid path member 200 will be retained within the trough 208. As described above, when the ink reclamation device 100 is in the vertical position shown in FIG. 3A the liquid path member 200 is sealed against the face 302 of the printhead 304 to receive all of the ink purged from the printhead jets. When the printhead is retracted, as shown in FIG. 3B, the molten ink within the trough of the member 200 solidifies to hold the ink within the reclamation device until it can be returned to the ink supply 306 of the printhead.

The solidified ink is held within the trough 208 even as the reclamation device 100 is pivoted to the position shown in FIG. 3C. In this position the reclamation device can be heated, such as by energizing the heating element 134, so that the solid ink within the trough 208 melts, including the ink covering each slot 220. The weight or pressure of the now liquid ink within the trough will bear against the liquid ink spanning the slots to overcome the surface tension that would otherwise re-form the meniscus at the opening. As the liquid ink flows from the liquid path member 200 the liquid ink level within the trough will be low enough that a meniscus can re-form at each slot, thereby plugging the slots again once the molten ink hardens. With the slots plugged the ink reclamation device 100 can be returned to its purge position shown in FIG. 3A to receive liquid ink in a new purge cycle.

The liquid path member 200 may be used in a 4-in-1 recirculation system, as illustrated in the figures. Separate liquid path members in separate reclamation elements 100 may be provided for each color in a multi-color printing device, as described above.

The liquid path member 200 may be formed entirely of a compliant or flexible material, as described above. Alternatively, only portions of the body 202 of the member 200 maybe flexible provided the portions allow the edge 214 to lie substantially flush with, or in a substantially fluid-tight relationship with, the face of the printhead, with the object being that substantially all of the liquid ink purged from the printhead jets is received within the trough 208. Thus, only the outer wall 212 may be flexible, or the base 215 may be flexible in the nature of a leaf spring. The slots 220 shown in the accompany figures are depicted as linear rectangular slots, but other opening configurations may be utilized provided that the dimensions of the openings support formation of a meniscus by the molten ink. In addition, the slots 220 are shown as extending transversely in relation to the longitudinal axis of the member 200. Alternatively, the slots may extend along the length of the member, or may include a single slot arranged along the length, with the width of the longitudinal slot or slots being sized to support the formation of a meniscus of molten ink.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. An ink reclamation device for a printing machine having a printhead with a face and inkjets at said face configured to purge liquid ink therethrough, said device comprising:

a liquid path member defining a trough for receiving purged liquid ink and including an outer wall configured to engage the face of the printhead, said member defining a number of openings at a base of said trough, said openings sized to support a formation of a meniscus by the liquid ink; and a positioning system operatively connected to the liquid path member and configured to move the member to a purge position in which said outer wall engages the face of the printhead to provide a fluid path to the trough for ink emitted from the inkjets.

2. The ink reclamation device of claim 1, wherein said liquid path member is configured so that said outer wall resiliently engages the face of the printhead in said purge position.

3. The ink reclamation device of claim 1, wherein said liquid path member is formed of a compliant sheet, said compliant sheet forming said outer wall.

4. The ink reclamation device of claim 1, wherein said liquid path member is a U-shaped body defining said trough, said U-shaped body including said outside wall.

5. The ink reclamation device of claim 1, further comprising a housing defining a receptacle and supporting said liquid path member within said receptacle so that liquid ink flowing through said openings flows into said receptacle, wherein said housing is coupled to said positioning system.

6. The ink reclamation device of claim 5, in which the printhead includes an ink reservoir separate from the face, wherein:

said housing defines an outlet in communication with said receptacle; and said positioning system is configured to move the housing to a position in which said outlet is arranged relative to the ink reservoir for liquid ink to flow into said reservoir from said receptacle.

7. The ink reclamation device of claim 1, further comprising a heating element associated with said liquid flow member and operable to heat ink contained within said trough.

8. The ink reclamation device of claim 1, wherein said number of openings includes a number of slots defined in said base of said trough, each of said number of slots having a width sized to support the formation of a meniscus of liquid ink.

9. The ink reclamation device of claim 8, in which the liquid path member has a longitudinal axis substantially parallel to said outer wall and said number of slots are arranged transversely to said longitudinal axis at the base of said trough.

10. The ink reclamation device of claim 9, wherein said number of slots includes a plurality of substantially uniformly slots spaced along the longitudinal axis of said liquid path member.

11. The ink reclamation device of claim 8, wherein said width is between about 0.25 mm and 1.0 mm.

12. The ink reclamation device of claim 8, wherein each of said number of slots has a length relative to said width that is greater than said width.

13. A printing machine comprising:

an ink reservoir for storing liquid ink;

a printhead with a face and inkjets at said face, said inkjets in communication with said ink reservoir to receive liquid ink therefrom, and said printhead configured to engage a pressure source to purge liquid ink from said inkjets; and an ink reclamation device for collecting liquid ink purged from said inkjets including;

a liquid path member defining a trough for receiving purged liquid ink and including an outer wall configured to engage the face of said printhead, said member defining a number of openings at a base of said trough, said openings sized to support a formation of a meniscus by the liquid ink; and a positioning system operatively connected to the liquid path member and configured to move the member to a purge position in which said outer wall engages the face of the printhead to provide a fluid path to the trough for ink emitted from the inkjets.

14. The printing machine of claim 13, wherein:

said ink reclamation device further includes a housing defining a receptacle having an outlet and supporting said liquid path member within said receptacle so that liquid ink flowing through said slots flows into said receptacle, said housing being coupled to said positioning system; and said positioning system is configured to move the housing to a position in which said outlet is arranged relative to said ink reservoir for liquid ink to flow into said reservoir from said receptacle.

15. The printing machine of claim 13, wherein said liquid path member is formed of a compliant sheet, said compliant sheet forming said outer wall.

16. The printing machine of claim 13, wherein said liquid path member is a U-shaped body defining said trough, said U-shaped body including said outside wall.

17. The printing machine of claim 13, wherein said ink reclamation device further includes a heating element associated with said liquid flow member and operable to heat ink contained within said trough.

18. The printing machine of claim 13, wherein said number of openings includes a number of slots defined in said base of said trough, each of said number of slots having a width sized to support the formation of a meniscus of liquid ink.

19. The printing machine of claim 18, in which the liquid path member has a longitudinal axis substantially parallel to said outer wall and said number of slots are arranged transversely to said longitudinal axis at the base of said trough.

20. The printing machine of claim 18, wherein said width is between about 0.25 mm and 1.0 mm.

* * * * *